US006468418B1

(12) United States Patent
Biscardi et al.

(10) Patent No.: US 6,468,418 B1
(45) Date of Patent: Oct. 22, 2002

(54) SORBENT TREATING OF LUBRICATING OILS TO REMOVE HAZE PRECURSORS

(75) Inventors: Joseph A. Biscardi, Berkeley; Kamala R. Krishna, Danville; John M. Rosenbaum, Richmond; Nadine L. Yenni, Sonoma; R. Larry Howell, Hercules; Krishnia Parimi, Concord, all of CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 09/590,441

(22) Filed: Jun. 9, 2000

Related U.S. Application Data

(63) Continuation-in-part of application No. 09/483,305, filed on Jan. 14, 2000, and a continuation-in-part of application No. 09/330,339, filed on Jun. 11, 1999.

(51) Int. Cl.[7] ..... C10G 25/00; B01J 8/02

(52) U.S. Cl. ..... 208/299; 208/28; 208/301; 208/305; 422/211; 422/212; 422/213

(58) Field of Search ..... 208/299, 301, 208/305, 18, 28, 950; 422/211

(56) References Cited

U.S. PATENT DOCUMENTS

| | | | | |
|---|---|---|---|---|
| 3,576,735 A | | 4/1971 | Murphy et al. | 208/27 |
| 3,617,475 A | * | 11/1971 | Offutt et al. | 208/33 |
| 3,862,026 A | * | 1/1975 | Friend et al. | 208/310 |
| 4,181,597 A | * | 1/1980 | Yan et al. | 208/46 |
| 4,367,364 A | | 1/1983 | Kulprathipanja et al. | 585/826 |
| 4,474,618 A | | 10/1984 | Yen et al. | 208/111 |
| 4,867,862 A | | 9/1989 | Ziemer | 208/27 |
| 4,917,789 A | * | 4/1990 | Butler et al. | 208/89 |
| 4,950,382 A | | 8/1990 | Yao et al. | 208/28 |
| 4,982,052 A | | 1/1991 | Nolte | 585/822 |
| 5,466,364 A | | 11/1995 | Kaul et al. | 208/307 |
| 5,525,312 A | | 6/1996 | Ramos, Jr. | 422/211 |
| 5,554,307 A | | 9/1996 | Dagorn et al. | 508/111 |
| 5,614,079 A | | 3/1997 | Farnos et al. | 208/27 |

* cited by examiner

*Primary Examiner*—Bekir L. Yildirim
(74) *Attorney, Agent, or Firm*—Penny L. Prater; Alan W. Klaassen

(57) ABSTRACT

A base oil feed having a tendency to form a haze at ambient or sub-ambient temperatures is contacted with a solid adsorbent to remove at least a portion of the haze precursors, thereby reducing the haze-forming tendency of the base oil feed.

32 Claims, 4 Drawing Sheets

SORBENT TREATING OF LUBRICATING OILS TO REMOVE HAZE PRECURSORS

This application is a continuation-in-part application of U.S. Ser. No. 09/330,339, filed Jun. 11, 1999, the entire disclosure of which is incorporated herein by reference for all purposes. This application is also a continuation-in-part application of U.S. Ser. No. 09/483,305, filed on Jan. 14, 2000, the entire disclosure of which is incorporated herein by reference for all purposes

BACKGROUND OF THE INVENTION

The present invention relates to a sorption process for dehazing a base oil feed. Lube base oils are normally prepared from crude oil distillates and residua or synthetic oils using a series of upgrading steps, which may include hydrocracking or solvent extraction to remove heteroatoms and aromatics and to increase the viscosity index of the base oil; dewaxing to remove wax; and a finishing step for stabilizing the product against oxidation and floc and color formation.

Conventional methods for removing wax from a base oil feed include solvent dewaxing and catalytic dewaxing. The degree of dewaxing during one of these dewaxing processes is generally determined by the desired product pour point, where the pour point is a measurement, expressed as a temperature, at which the sample will begin to flow under carefully controlled conditions. Pour point may be determined by, for example, ASTM D5950-96. The cloud point of a lube base oil is complementary to the pour point, and is expressed as a temperature at which a lube oil sample begins to develop a haze under carefully specified conditions. Cloud point may be determined by, for example, ASTM D5773-95. Generally, both the pour point and the cloud point are decreased diring dewaxing.

Some base oil feeds, particularly heavy streams such as bright stock, contain naturally-occurring haze precursors that are more difficult to remove by conventional dewaxing than are the paraffinic waxes which predominate in lower boiling waxy streams. If present in sufficient quantities, the haze precursors form a haze in the base oil at ambient (or lower) temperatures, particularly if the base oil is allowed to stand at the low temperature for some time, e.g. overnight. The base oil may develop a hazy appearance even after being dewaxed to allow pour-point, e.g. less than −5° C.

Conversely, the hazgenerally disappears when the base oil is heated slightly, e.g. to a temperature of 80° F. or above. The haze will generally be the color of the base oil in which it forms, and is usually white when present in otherwise colorless oil. Haze precursors which give rise to the hazy appearance have significant paraffinic character, some with cyclic components having a long paraffin-like tail. As such, these haze precursors are expected to have substantially different molecular structures than do the color bodies and heteroatom molecules removed by conventional clay filtering for oil stabilization. The presence or absence of a visual haze may be determined using the clear-and-bright standard of ASTM D-4176-93 (Reapproved 1997). The haze may also be quantified by measure of clarity.

While the haze generally has little or no effect on the performance of the base oil as a lubricating oil base stock, its presence suggests degraded visual quality and low temperature performance. A method of reducing the haze tendency of a base oil is desired.

SUMMARY OF THE INVENTION

The present invention is directed to a process for removing a substantial portion of the haze precursors from a base oil feed, and more preferably from a dewaxed base oil feed, with little or no reduction in lube stock yield. Accordingly, the present invention provides a sorption process for producing an improved lube oil with a reduced tendency to form a haze after standing at ambient temperatures, the process comprising contacting a base oil feed with a solid sorbent for a time and at conditions sufficient to produce a dehazed base stock having a reduced cloud point relative to that of the base oil feed.

Unlike conventional dewaxing processes, the present sorption process reduces the cloud point of the base oil feed with little or no effect on the yield of lube base oil. The yield of lube stock based on the weight of base oil feed to the sorbent bed is greater than about 95%, and preferably greater than about 98%. Yields of up to 100% can be expected in some cases during steady state operation. A base oil which is a preferred feedstock for the present process has a low pour point, typically less than −5° C., though the pour point may be as low as −40° C. and lower, and a pour-cloud spread of 10° C. or more, and preferably 15° C. or mare. The cloud point of the feedstock is above −5° C., generally above 0° C., and may be as high as 30° C. or higher. In the process, the cloud point of the dehazed base oil is reduced relative to the base oil feed to the process. Preferably, the cloud point of the dehazed product from the process is less than 15° C., and more preferably less than 10° C.

Preferred sorption condition for removing the haze includes a temperature in the range of 15° C. (60° F.) and 60° C. (140° F.), and a flow rate of hazy oil of between 0.01 $hr^{-1}$ and 10 $hr^{-1}$.

Further to the invention is a process for producing an improved base oil with a reduced tendency to form a haze after standing at ambient temperatures, the process comprising contacting a base oil feed, having a viscosity of greater than 6.5 cSt (measured at 100° C.), a pour point of less than −5° C., and a pour-cloud spread of 15° C. or more, with a solid sorbent at a temperature of less than 66° C. and at a flow rate of less than 10 $hr^{-1}$ WHSV, and producing a dehazed base oil having a cloud point of at least 5° C. lower temperature than that of the base oil feed.

Among other factors, the present invention is based in part on the discovery that certain heavy oil streams develop a visual haze on standing, even when they have been dewaxed to a target pour point using conventional methods. The haze occurs in certain oils having a cloud point above −5° C., and more often above 0° C. or +5° C., with a pour-cloud spread of greater than 10° C. The present invention is further based on the surprising discovery that the haze precursors which give rise to the visual haze in these oils may be effectively removed by contacting the oil with solid sorbent particles. Wax-like molecules which are expected to substantially contribute to the hazy characteristic of such a base oil would not necessarily be expected to readily and preferentially adsorb on such a sorbent. The sorption process for removing the haze precursors improves the clarity and reduces the turbidity of the oil. In the process, the pour-cloud spread of the feed oil is reduced without substantially affecting pour point, at yields approaching 100%.

IN THE FIGURES

DETAILED DESCRIPTION

Figure 1:
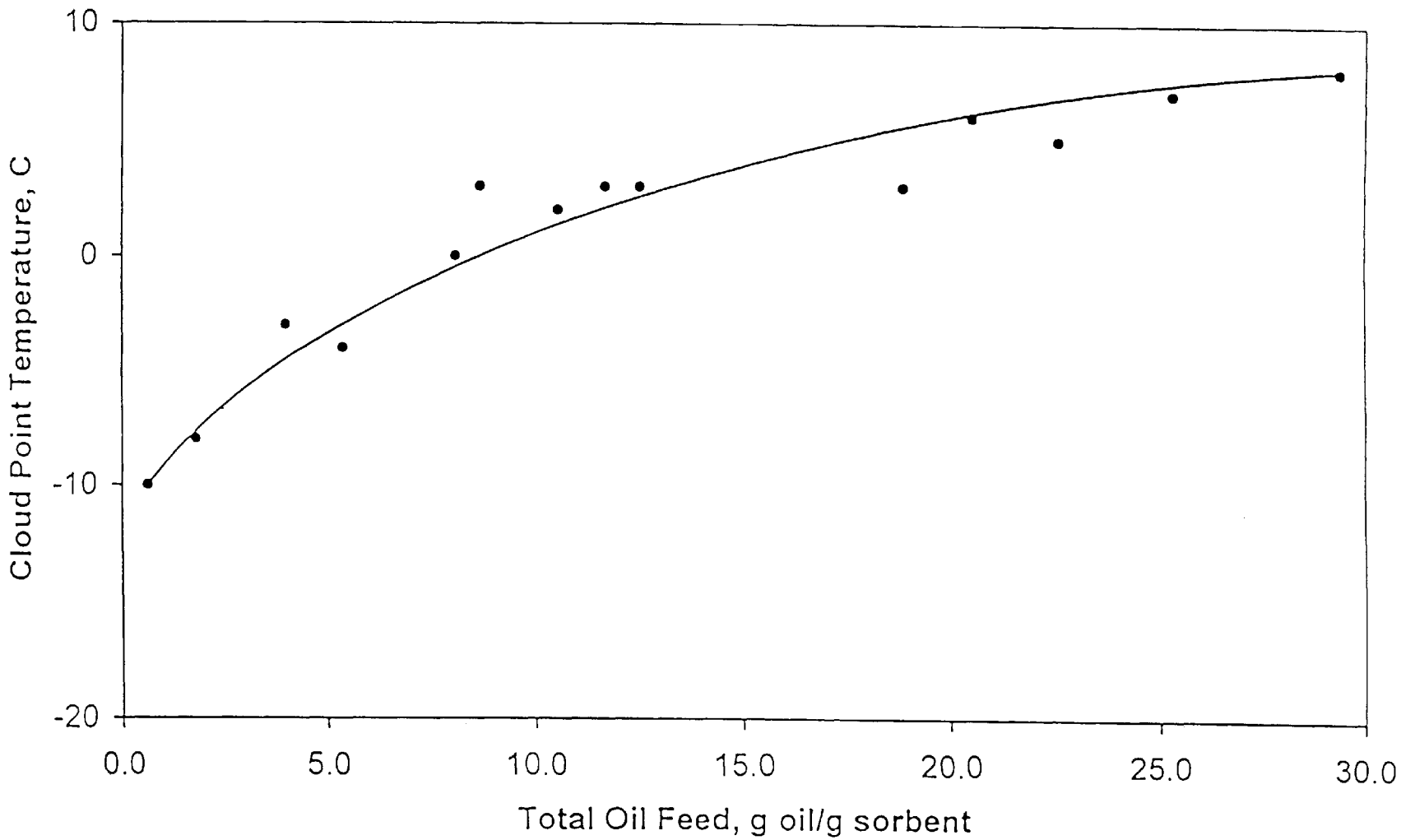
FIG. 1 illustrates the change in the cloud point of a lube base oil product from the sorption step as a function of the time onstream.

In principle, any waxy stock may be dehazed in the present process. Because of the relative efficiency of conventional dewaxing processes such as solvent dewaxing and, in particular, catalytic dewaxing, waxy stocks are preferably first dewaxed using one of these conventional methods, with the present process being used to remove the haze precursors remaining after a conventional dewaxing step. The process is most preferably used following a catalytic dewaxing process, since the haze precursors tend to be more abundant in a catalytically dewaxed base oil. The present process is useful for treating streams characterized by a wide range of boiling points. Refinery streams such as diesel feed, waxy middle distillate, lube oils, gas oils and vacuum gas oils, white oils and the like may be treated using the present process. A preferred base oil generally boils above about 500° F. (260° C.) and has a viscosity, measured at 100° C., of at least 2.0 cSt. Heavier base oil products typically are more prone to developing a hazy appearance on standing. For this reason, feeds having a viscosity greater than 6.5 cSt, measured at 100° C., are ideally suited for the present process.

Exemplary feeds suitable for dewaxing to prepare the feed for use in the process of the invention include waxy distillate stocks such as gas oils, lubricating oil stocks, synthetic oils such as those by tischer-Tropsch synthesis, high pour point polyalphaolefins, foots oils, synthetic waxes such as normal alphaolefin waxes, slack waxes, deoiled waxes and microcrystalline waxes. Foots oil is prepared by separating oil from the wax. The isolated oil is referred to as foots oil. The feedstock employed in the process of the invention may be a waxy feed which contains greater than about 50% wax, even greater than about 90% wax. Highly paraffinic feeds having high pour points, generally above about 0° C., more usually above about 10° C. are also suitable for use in the process of the invention. Such a feeds can contain greater than about 70% paraffinic carbon, even greater than about 90% paraffinic carbon. The base oil feed may be a vacuum gas oil or deasphalted residua which has been hydrocracked to improve product quality, remove heteroatoms and aromatics and increase viscosity index. The present process is particularly advantageous for removing haze precursors from heavy (i.e. high boiling) stocks such as heavy vacuum gas oils, heavy neutral base oils, bright stock, synthetic oil and the like. Such heavy stocks may be recovered from a mineral oil refining process or from a Fischer Tropsch process. Thus, the boiling point temperature range of the feed to the present process will generally be above about 250° F., preferably above about 500° F., and more preferably above about 850° F.

Bright stock is one preferred feedstock for the present process. Bright stock is derived from a residual oil, optionally via a upgrading step such as solvent deasphalting, and having a boiling point temperature range above about 900° or 925° F., and includes those materials which can only be distilled, without cracking, under a vacuum. Bright stock may also be recovered as a heavy fraction from a hydrocracking process, including hydrocracking a heavy VGO, a residuum, or a heavy synthetic wax such as from a Fischer Tropsch process. A bright stock generally has a viscosity, measured at 100° C., between 20 and 60 cSt, and a viscosity index of greater than about 80, and generally greater than about 90. Bright stocks having a viscosity index of 120 and higher may also be treated in the process.

The feed to the present process has a pour point of less than 0° C., usually a pour point of less than −5° C., or less than −10° C., down to a pour point of −40° C. and below. The feed also has a cloud point which is greater than the pour point of the feed, the cloud point being generally greater than −5° C., often greater than 0° C., or greater than 5° C. or 10° C., or even 20° C., up to as high as 30° C. or higher. In addition, the oil feed has a pour-cloud spread of 10° C. or more, frequently of 15° C. or more, or 20° C. or more, or 30° C. or more, up to 70° C. or more. As used herein, the pour-cloud spread of a sample oil is the difference in temperature between the cloud point and the pour point of the sample oil. For example, a sample oil with a cloud point of 5° C and a pour point of −5° C. has a 10° C. pour-cloud spread. Thus, the preferred oil supplied as feed to the present process has a cloud point greater than −5° C. and usually greater than 0° C., the base oil being characterized further by a pour-cloud spread of 10° C. or more. This feed is distinguished from a solvent dewaxed stock, which typically has a pour-cloud spread equal to or near zero.

The lube base stock recovered from the sorption step has a substantially reduced cloud point relative to the cloud point of the base oil feed to the sorption process. While the pour point may also be somewhat reduced during sorption according to the invention, the cloud point is more significantly reduced.

In the process of the invention, the pour-cloud spread is reduced in the dehazed oil by at least 5° C. relative to the pour-cloud spread of the base oil feed and may be reduced by as much as 20° C. or higher. In order to reduce the haze-forming tendency of a dehazed base oil to an acceptable level, it is preferred that the cloud point of the dehazed base stock be less than about 15° C., more preferably less than 10° C., still more preferably less than 5° C., down to the pour point of the dehazed base oil or even below. In contrast to the pour-cloud spread, the pour point of the base oil feed is not substantially reduced during the sorption process, and yields of treated product approach 100%. Specifically, the pour point is reducing during sorption by no more than 5° C., preferably by no more than 3° C., and often by no more than 2° C.

A measure of haze in dehazed product of this invention may also be derived from a turbidity test. Turbidity may be measured using a turbidity meter, such as a Hach Co. Model 2100 P Turbidimeter. A turbidity meter is a nephelometer that consists of a light source that illuminates the oil sample and a photoelectric cell that measures the intensity of light scattered at a 90° angle by the particles in the sample. A transmitted light detector also receives light that passes through the sample. The signal output (units in nephelometric turbidity units or NTUs) of the turbidimeter is a ratio of the two detectors. Meters can measure turbidity over a wide range from 0 to 1000 NTUs. The instrument must meet US-EPA design criteria as specified in US-EPA method 180.1. The following table correlates NTU values measured for a number of representative oil samples at 25° C. with the onset of a hazy appearance:

| NTU Value | Appearance |
|---|---|
| 20 | Cloudy |
| 2–5 | Possibly acceptable, but noticeable haze |
| 0.5–2 | Clear and bright |

For purposes of this application, the NTU values were determined at 25° C. unless otherwise indicated.

It has been surprisingly discovered that a base oil having a high cloud point, and/or a high pour-cloud spread may have an acceptable NTU value, such that the haze-forming tendency of the oil is reduced to acceptable levels. Such an oil will have an NTU value of less than 2.

Surprisingly, while the cloud point and NTU value of the feedstocks to the present process are significantly reduced during sorption, the pour point is generally little affected, especially for heavy oils. While reducing the cloud point and NTU values to acceptable levels, the pour point typically decreases by only a few degrees, e.g. 2° C. or less. Only in extreme cases, while treating very high cloud point oils, does the pour point decrease by as much as 5° C. during sorption.

The lube stock which is treated in the present process will usually have been dewaxed in either a solvent dewaxing process or in a catalytic dewaxing process or in a combination of the two processes. Such processes are well known, and do not require extensive discussion here.

Catalytic dewaxing processes have been taught in U.S. Pat. Nos. 4,859,311, 5,246,566, 5,282,958 and 5,376,260. Exemplary catalysts taught for catalytic dewaxing include the zeolites ZSM-5, ZSM-11, ZSM-21, ZSM-22, ZSM-23, ZSM-35, ZSM-38, ZSM-48, ZSM-50, ZSM-57, SSZ-20, SSZ-32, ferrierite and L and other molecular sieve materials based upon aluminum phosphates such as SAPO-11, SAPO-31, SAPO-41, MAPO-11 and MAPO-31.

Dewaxing conditions generally include a temperature which falls within a range from about 200° C. to about 400° C. and a pressure from about 15 to about 3000 psig (0.10–20.7 MPa). More preferably the pressure is from about 100 to about 2500 psig (0.69–17.2 MPa). The liquid hourly space velocity during contacting is generally from about 0.1 to about 20, more preferably from about 0.1 to about 5. The contacting is preferably carried out in the presence of hydrogen. The hydrogen to hydrocarbon ratio preferably falls within a range from about 1.0 to about 50 moles $H_2$ per mole hydrocarbon, more preferably from about 10 to about 30 moles $H_2$ per mole hydrocarbon.

The product of the present invention may be further treated, such as by hydrofinishing. The hydrofinishing can be conventionally carried out in the presence of a metallic hydrogenation catalyst, for example, platinum on alumina. The hydrofinishing can be carried out at a temperature of from about 190° C. to about 340° C. and a pressure of from about 400 psig to about 3000 psig (2.76–20.7 MPa). Hydrofinishing in this manner is described in, for example, U.S. Pat. No. 5,393,408, which is incorporated herein by reference.

In the embodiment which includes dewaxing and hydrofinishing steps, the sorption process of this invention preferably follows both the dewaxing and hydrofinishing steps. However, under some conditions, the use of a sorption step according to this invention may eliminate the need for a separate hydrofinishing step.

Sorbents useful as sorption media for the present process are generally solid particulate matter having high sorptive capacity and with a surface having some acidic character. Sorbents with acid character have a measurable acid site density, determined using well-known infra-red spectroscopic measurements of adsorbed basic molecules such as ammonia, n-butylamine and pyridine. Crystalline molecular sieves (including aluminosilicate zeolites), activated carbon, aluminas, silica-alumina and clays, particularly acid-activated clays, are examples of useful sorbents. A mixture of sorbents or a layered sorbent system may also be used. Manufactured and naturally-occurring aluminas are particularly preferred for the sorption process. Such aluminas include pseudo-boehmite, gamma alumina and alpha alumina. Depending on the application, powders or particles (e.g. extrudates) of alumina may be preferred. For fixed bed applications, alumina extrudates ranging in size from 1/20 inch to 1/8 inch cross sectional diameter are preferred.

Examples of suitable clay sorbents include bauxite, Fuller's earth, attapulgite, montmorillonite, halloysite, sepiolite, and other clays having adsorption properties, whether or not activated with acid. The clay adsorbent used for pretreating the oil is generally in the particle size range of 250–2000 microns. Preferred clays for use in the present process include acid activated clays, generally prepared by treating clay, such as a bentonite clay, with mineral acids to yield a modified clay product of high surface area and acidity and having enhanced adsorptive properties. Acid activated clays are generally described in D. R. Taylor and D. B. Jenkins, *Acid-activated Clays*, Society of Mining Engineers of AIME (Transactions), vol 282, p. 1901–1910, the entire disclosure of which is incorporated herein by reference. One acid activated clay is a nonswelling bentonite that has been treated with mineral acid to enhance its capacity for adsorbing pigments from oils. A bentonite is a clay ore whose principal mineral in montmorillonite, an end-member of the smectite clay mineral group characterized by a three-layered structure composed of two silica sheets sandwiches about a central alumina sheet. A typical, non-limiting, formula of montmorillonite is:

$$Si_8(Al_{3.34}Mg_{0.66})O_{20}(OH)_4 \cdot 0.66\ Na$$

Crystalline molecular sieve materials also may be used in a adsorption bed for removing the haze precursors from the base oil. Any zeolite having surface acidity, such as zeolites Y, USY, X, A, beta, L, ZSM-5, SSZ-32 and the like may be used. Other molecular sieves include crystalline aluminophosphates such as AIPO- 11, crystalline silicoaluminophosphates such as SAPO-11 and the like. Molecular sieve adsorbents may be granular or as shaped particles of a suitable size, usually smaller than 1 cm effective diameter.

In the sorption process, contacting can be performed in batch mode, e.g., a volume of sorbent is added, preferably with stirring, to a volume of oil, permitted to stand, then the oil is drained or filtered and a new oil charge is added.

Alternatively contacting can be performed under continuous conditions using a fixed bed, moving bed, slurry bed, simulated moving bed or magnetically stabilized fluidized bed and employing either upflow, downflow or radial flow continuous oil circulation. A vessel useful for contacting the dewaxed oil with a sorbent in radial flow is disclosed in copending application entitled, "Apparatus for Treating Lubricating Oils to Remove Haze Precursors" filed Jun. 9, 2000, the entire disclosure of which is incorporated herein by reference for all purposes.

During the sorption process using downflow oil circulation, the oil is allowed to pass downward through a sorbent bed, packed with one or more clays or other sorbents useful for reducing the cloud point of the base oil feed. The sorption process is preferably run at temperatures below 66° C. and more preferably at a temperature in the range between about 10° C. and about 50° C., and at a oil flow rate of up to 10 $hr^{-1}$ weight hourly space velocity (WHSV), more preferably at a oil flow rate in the range of 0.01 to 10 $hr^{-1}$, most preferably in the range of 0.1 to 5 $hr^{-1}$, still more preferably in the range of 0.25 to 2.5 $hr^{-1}$. The rate at which the haze precursors are adsorbed is improved by lowering the adsorption temperature. Ambient pressures or above are generally preferred. It will be immediately obvious to the skilled practitioner that the temperature for removing the haze in the present process is much less than the temperatures used in commercial operations for reducing color from oil using a solid sorption process.

Figure 4:
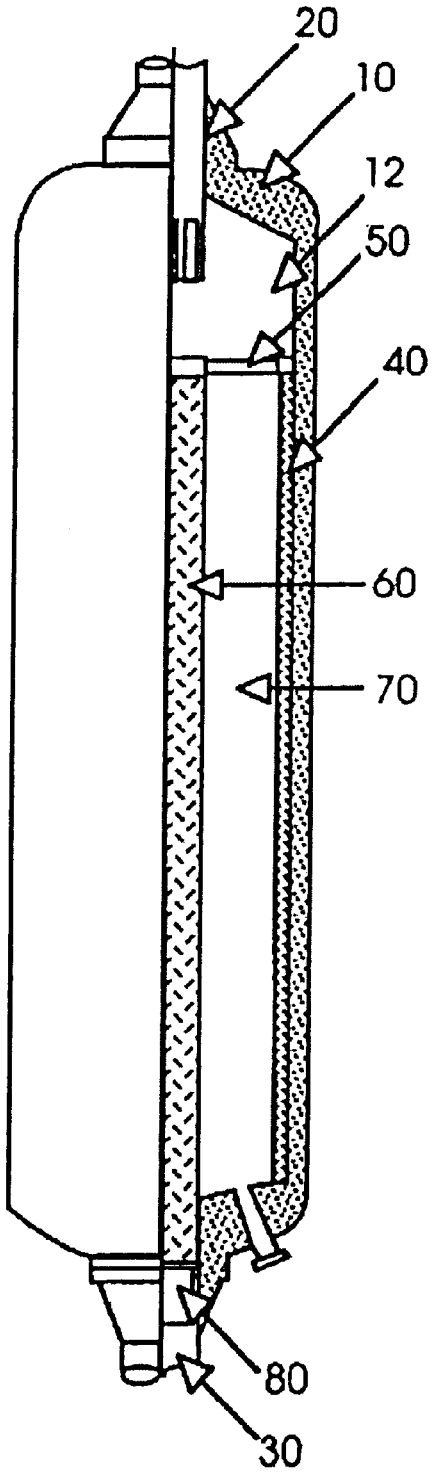
FIG. 4 is a block diagram of a vessel for use in the process of the invention.

Referring to FIG. 4, which shows a half cutaway view of a side elevation of one embodiment of a vessel useful for contacting the oil with a sorbent in radial flow according to the present sorption process, the vessel has a shell 10 having an internal cavity 12. Towards the top of the shell, an inlet means 20 is connected to internal cavity 12 to afford passage of material into the cavity. Within the bottom of the vessel shell 10 is an outlet means 30. That outlet means 30 is connected to internal cavity 12 to afford passage of material out of the cavity. Within internal cavity 12 is a porous support means 40 that lines a lower portion of the internal surface of shell 10. Porous support means 40 helps to support the sorbent bed within annulus 70, and further permits the flow of fluid into the sorbent bed. Porous support means 40 may be in the form of scallops, or vertical tubes lining the internal surface of shell 10, or a concentric porous column lining the internal surface of shell 10 and providing a cavity space between the internal surface of shell 10 and porous support means 40. Also within internal cavity 12 is a cover means 50 that rests upon the top of porous support means 40.

A porous, vertical, hollow centerpipe 60 fits within internal cavity 12, and below cover means 50, to form an annulus 70 between porous support means 40 and centerpipe 60. The bottom of centerpipe 60 rests on a ledge within outlet means 30 to block access of flow of solids from annulus 70.

In a sorption vessel, the annulus would contain sorbent. The material flowing into the cavity would be oil having a tendency to form haze. That material flows downward, past the cover means and through the porous support means into the annulus, where it contacts the sorbent. The dehazed product flows through the porous centerpipe and out through the outlet means.

A blocking sleeve 80 is within vessel shell 10 for preventing the flow of solids from annulus 70 to outlet means 30.

The oil feed to the process may be added to the sorbent bed with or without dilution. In some cases, it may be preferred to cut the high viscosity of the oil feed with a light solvent, which is then removed following sorption. A suitable solvent will dissolve the oil feed, and will remain a liquid (minimal volatilization) during the sorption process. Regardless of whether a solvent is used, the sorption process will continue until the cloud point of the treated oil product increases above a predetermined maximum, indicating that the adsorbent has become saturated. The sorbent then may be regenerated or replaced. As a rule, the quantity of oil pretreated by the solid adsorbent according to the present process lies between 1,000 gallons of oil per ton of sorbent to about 80,000 gallons of oil per ton of adsorbent, preferably between 2,000 and 40,000 gallons per ton, before the sorbent must be regenerated or replaced.

At the start of a sorption process, using fresh or freshly regenerated sorbent, the sorbent will absorb an amount of oil until saturated. Indeed, the sorbent bed may swell during the first period of the sorption process as a result of oil sorption. At steady state operation, with the sorbent saturated with oil, yields of lube stock having the haze precursors removed in the sorption process are generally greater than 95%, often greater than about 98%, up to 100% yield based on base oil feed to the sorption process.

Sorbent which has become saturated with adsorbed haze precursors may be regenerated by heating to a temperature above the adsorption temperature and sweeping the sorbent with a fluid to remove the haze precursors. Gaseous and/or liquid sweep fluids may be used. A preferred regeneration method includes heating the sorbent containing sorbed haze precursors at a temperature of about 66° C. or higher, preferrably between 65° C. and 120° C., passing the base oil feed through the sorbent to remove adsorbed haze precursors, and withdrawing a stream containing a high amount of haze precursors for reaction in other refinery processes. Both polar and non-polar solvents may also be used to remove adsorbed haze precursors at temperatures above and below 66° C., including paraffins such as hexane, aromatics such as benzene, toluene and xylene, and polars such as methyl ethyl ketone, and refinery steams such as diesel or light lubes.

In a non-limiting example, the present process for producing an improved base oil with a reduced tendency to form a haze after standing at ambient temperatures, comprises contacting a base oil feed having a viscosity of greater than 6.5 cSt (measured at 100° C.), a pour point of less than −5° C., and a pour-cloud spread of greater than 15° C., with a solid sorbent at a temperature of less than 66° C. and at a flow rate of less than 10 $hr^{-1}$ WHSV and producing a dehazed base oil having a reduced pour-cloud spread relative to that of the dehazed base oil. In a preferred embodiment, the base oil feed is contacted with a sorbent, preferably an alumina or clay sorbent, and more preferably an alumina sorbent, at a temperature of less than 66° C., preferably between 10° and 50° C. (e.g. 27° C.) for between 15 minutes and 2 hours. In a separate preferred embodiment, the base oil feed has an NTU value of greater than 2.0 and, more preferably, the dehazed base oil has an NTU value of less than 2.0. In the most preferred embodiment, the dehazed oil leaving the process will have a pour point of less than −9° C., a cloud point of less than 10° C. and an NTU value of less than 2.0.

The following examples are presented as illustrating preferred embodiments of this invention and are not intended as undue limitations on the generally broad scope of the invention as set out in the appended claims.

EXAMPLES

Example 1

A sample of Tonsil CO 630G, (an acid activated calcium bentonite from Süd-Chemie Indonesia) having the properties shown in Table I, was dried at 120° C. and contacted with hazy bright stock having a pour point of −14° C. and a cloud point of 13° C. After passing the bright stock sample through the Tonsil CO 630G clay bed at 110° F., the resultant oil had a pour point of −26° C. and a cloud point of −5° C. The test was repeated using bauxite as the adsorbent. The resultant oil had a pour point of −22° C. and a cloud point of 5° C.

TABLE I

| | |
|---|---|
| Bulk density, g/l | 500–600 |
| Free moisture (2 h, 110° C.), % max | <6% |
| Loss on ignition (2 h, 1000° C.), % max | <10% |
| pH (10% suspension, filtered) | 2.4–3.0 |
| Free Acidity, mg KOH/g | 2.7–3.3 |
| Total Acidity, mg KOH/g | 9.0–12.0 |
| Surface area, $m^2/g$ | 230–250 m |
| Micropore volume (0–80 nm), ml/g | 0.30–0.35 |
| Particle size | >90 wt % through 20 mesh (850 μm) <10% through 60 mesh (250 μm) |

Example 2

Tonsil CO 630G was tested using a bright stock sample (Table II) with a cloud point of 12° C. and a pour point of −21° C. The bright stock was passed over a 13.8 gram sample of Tonsil CO 630G at a feed rate of nominally 0.065 $hr^{-1}$ WHSV, a temperature of 28° C. (82° F.) and at a positive pressure above ambient of between 20.7 KPa (3 psig) and 96 KPa (14 psig). The effectiveness of this acid-activated clay for removing the haze precursors is seen in FIG. 1, which illustrates the change in the cloud point of the lube base oil product from the sorption step as a function of the time onstream. The initial cloud point of the product was −10° C., and the clay continued to remove haze precursors until the clay had treated 30 grams oil per gram sorbent.

TABLE II

| Bright Stock Properties | |
|---|---|
| VI | 115 |
| vis @ 100° C. | 27.13 cSt |
| vis @ 40° C. | 314.6 cSt |
| Pour Point | −21° C. |
| Cloud Point | +12° C. |
| Weight % Aromatics | 0.2592 |

Example 3

Tonsil CO 630G and a Pural γ-alumina were tested for dehazing a dewaxed commercial Fischer-Tropsch wax sample obtained from Moore and Munger, N.Y. Inspections of the dewaxed sample are given in Table III. The sample had a cloud point of +29° C. and a pour point of −51° C. After passing through Tonsil CO 630G at a WHSV of 1 $hr^{-1}$, the cloud point of the sample dropped to −8° C.; when passed through the alumina at 3.6 $hr^{-1}$, the cloud dropped to −20° C.

TABLE III

| Dewaxed Fischer-Tropsch Wax Sample | |
|---|---|
| Vis @ 100° C. | 9.238 cSt |
| Vis @ 40° C. | 57.99 cSt |
| VI | 140 |
| Density | 0.083 $g/cm^3$ |
| Pour Point | 51° C. |
| Cloud Point | +29° C. |

TABLE III-continued

| Dewaxed Fischer-Tropsch Wax Sample | | |
|---|---|---|
| SimDist TBP (Wt %) | ° F. | ° C. |
| 0.5/5 | 692/716 | 367/380 |
| 10/30 | 738/828 | 392/442 |
| 50 | 918 | 492 |
| 70/90 | 1015/1158 | 546/656 |
| 95/99.5 | 1214/1312 | 657/711 |

Example 4

Example 3 was repeated with dewaxed heavy neutral base oil using Pural γ-alumina. Results are shown in Table IV. The results show a significant decrease in the cloud point, even at very high oil flow rate.

TABLE IV

| Dewaxing Heavy Neutral Base Oil | | |
|---|---|---|
| Feed Properties | | |
| Cloud Point, ° C. | 11 | |
| Pour Point, ° C. | −11 | |
| Test No. | IV-A | IV-B |
| Oil Flow Rate (WHSV), hr-1 | 3.2 | 3.75 |
| Product Properties | | |
| Product Cloud Point, ° C. | −5 | −1 |
| SimDist TBP (Wt %) | ° C. | ° C. |
| 0.5/5 | 363/423 | 364/420 |
| 10/30 | 446/486 | 443/486 |
| 50 | 509 | 509 |
| 70/90 | 533/564 | 532/563 |
| 95/99 | 579/624 | 578/614 |

Example 5

A group of sorbent materials were tested for dehazing a dewaxed bright stock having a cloud point of 14° C. and a pour point of −14° C., and a clarity as measured by a Hach Turbidimeter (Model 2100P) of 10.70 NTU at 25° C. An equal volume of bright stock was passed in turn over a fresh sample of each of the sorbents listed in Table V at the indicated feed rate. The dehazed product following adsorption was evaluated for cloud point.

The results shown in Table V show that the alumina adsorbents, as a class, were the most effective for reducing the cloud point and the clarity of the hazy oil to acceptably low levels. Furthermore, the alumina were more effective for reducing the haze tendency of the oil than were adsorbents normally used for color removal of colored stock.

TABLE V

| Adsorbent | Flow rate of oil through sorbent bed WHSV, $h^{-1}$ | Cloud Point ° C. of dehazed oil | Clarity NTU |
|---|---|---|---|
| No Adsorbent | | 14 | 10.7 |
| Pseudo-Boehmite Aluminas | | | |
| Harshaw Pural-HH303 | 0.51 | −11 | 0.17 |
| Harshaw Pural-HH303 | 0.74 | −10 | |

TABLE V-continued

| Adsorbent | Flow rate of oil through sorbent bed WHSV, $h^{-1}$ | Cloud Point ° C. of dehazed oil | Clarity NTU |
|---|---|---|---|
| Harshaw Pural-HH303 | 0.98 | −1 | |
| Vista Catapal B-AP0079 | 0.49 | −14 | |
| Condea Catapal B-7558 | 1.15 | −4 | 0.21 |
| Condea Catapal B-7558 | 0.36 | −13 | |
| Na-exc Condea Catapal B-7558 | 0.27 | −12 | |
| Gamma Aluminas | | | |
| Calcined Vista Catapal B-AP0079 | 0.88 | −2 | 0.33 |
| Calcined Harshaw Pural-HH303 | 0.60 | −1 | |
| Other Aluminas | | | |
| Alundum | 0.04 | 11 | |
| Alpha Alumina | 0.08 | −12 | 0.39 |
| Alpha Alumina | 0.44 | 0 | |
| Neutral Alumina | 1.11 | 9 | 10.30 |
| Reheis F-2000 | 0.08 | 6 | |
| Bayerite Alumina | 0.13 | −3 | |
| Theta Alumina | 0.09 | 6 | |
| Bentonite | | | |
| Tonsil 630 | 0.001 | −9 | |
| Tonsil 630 | 0.06 | 1 | |
| Tonsil 616 | 0.06 | 2 | |
| Zeolites | | | |
| H-Y Zeolite | 0.07 | 1 | |
| H-ZSM-5 Zeolite | 0.1 | 3 | |
| H-SSZ-32 Zeolite | 0.07 | 4 | |
| Na-ZSM-5 Zeolite (partially Na exchanged) | 0.13 | 5 | |
| 5A Zeolite | 0.04 | 10 | |
| 13X Zeolite | 0.04 | 8 | 1.24 |
| Other | | | |
| Bauxite | 0.03 | 2 | |
| $Ga_2O_3$ | 0.29 | 2 | |
| Nafion Ion Exchange Resin | 0.05 | 3 | |
| Alumina bauxite + gamma | 0.07 | 3 | |
| Activated Carbon | 0.03 | 4 | |
| Silica Gel | 0.033 | 7 | |
| $ZrO_2$ | 0.17 | 5 | |
| $TiO_2$ | 0.04 | 8 | |
| MgO | 0.38 | 11 | |
| Attapulgite | 0.18 | 3 | |
| Solid Phosphoric Acid | 0.02 | 8 | |
| $SiO_2/TiO_2$ | 1.35 | 14 | |
| $WO_3/ZrO_2$ | 0.43 | 9 | |
| $SiO_2/Al_2O_3$ | 0.08 | 3 | |

Example 6

Figure 2:
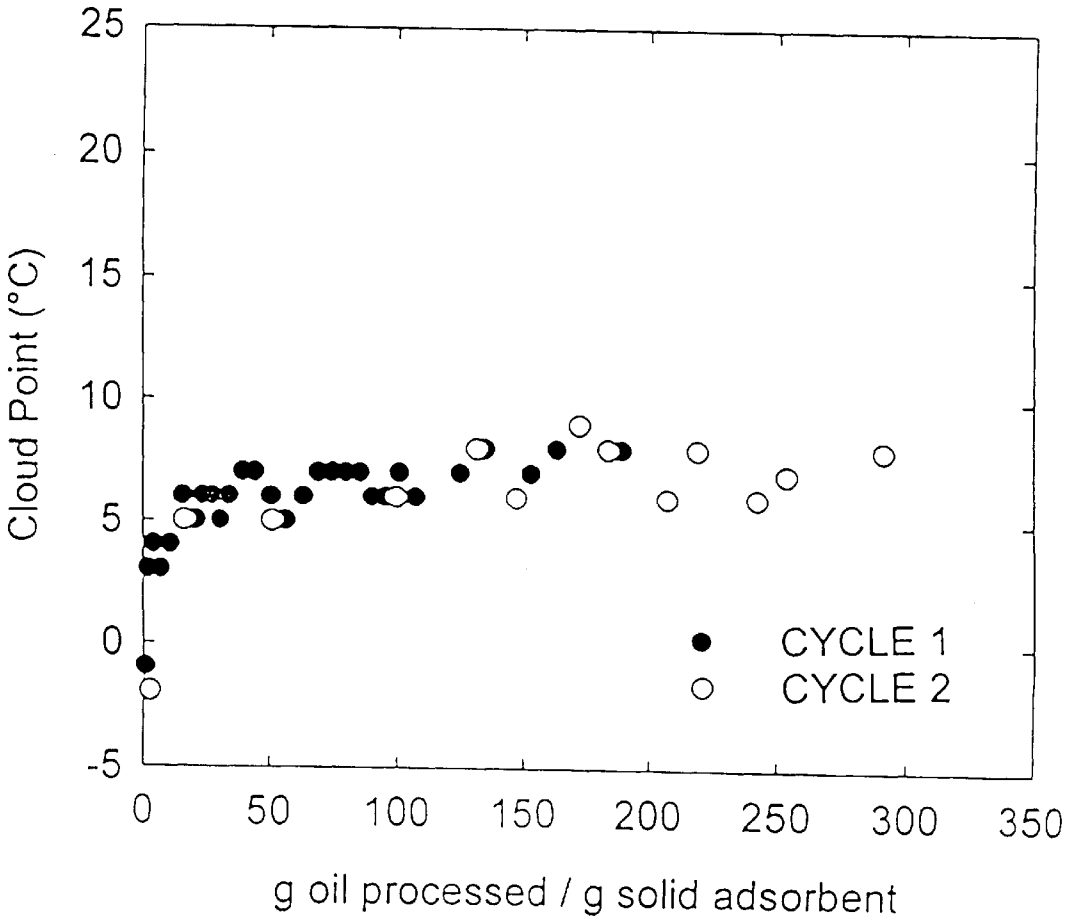
FIG. 2 illustrates the cloud point reduction of a hazy bright stock which is passed through a-pseudo-boehmite alumina adsorbent.

The lifetime of pseudo-boehmite alumina adsorbent was tested using dewaxed bright stock having a pour point of −25° C. and a cloud point of +23° C. (FIG. 2). The temperature of the adsorbent bed (27° C.) and feed rate of the dewaxed oil (1.3–1.5 $hr^{-1}$ WHSV) were held constant during the experiment. The alumina adsorbent reduced the cloud point of the bright stock feed to about +8° C. while treating more than 175 grams of oil per gram of alumina adsorbent (FIG. 2). The alumina was then regenerated by heating the adsorbent bed to 66° C. and passing a hexane solvent over the alumina. After regeneration, the alumina bed was cooled to 27° C. and the hazy bright stock again passed over the alumina. During the second cycle, the alumina reduced the cloud point of the dewaxed oil to +8° C. while treating an additional 300 grams of oil per gram of alumina adsorbent at a feed rate of 1.4 to 2.0 $hr^{-1}$ WHSV.

Example 7

Figure 3:
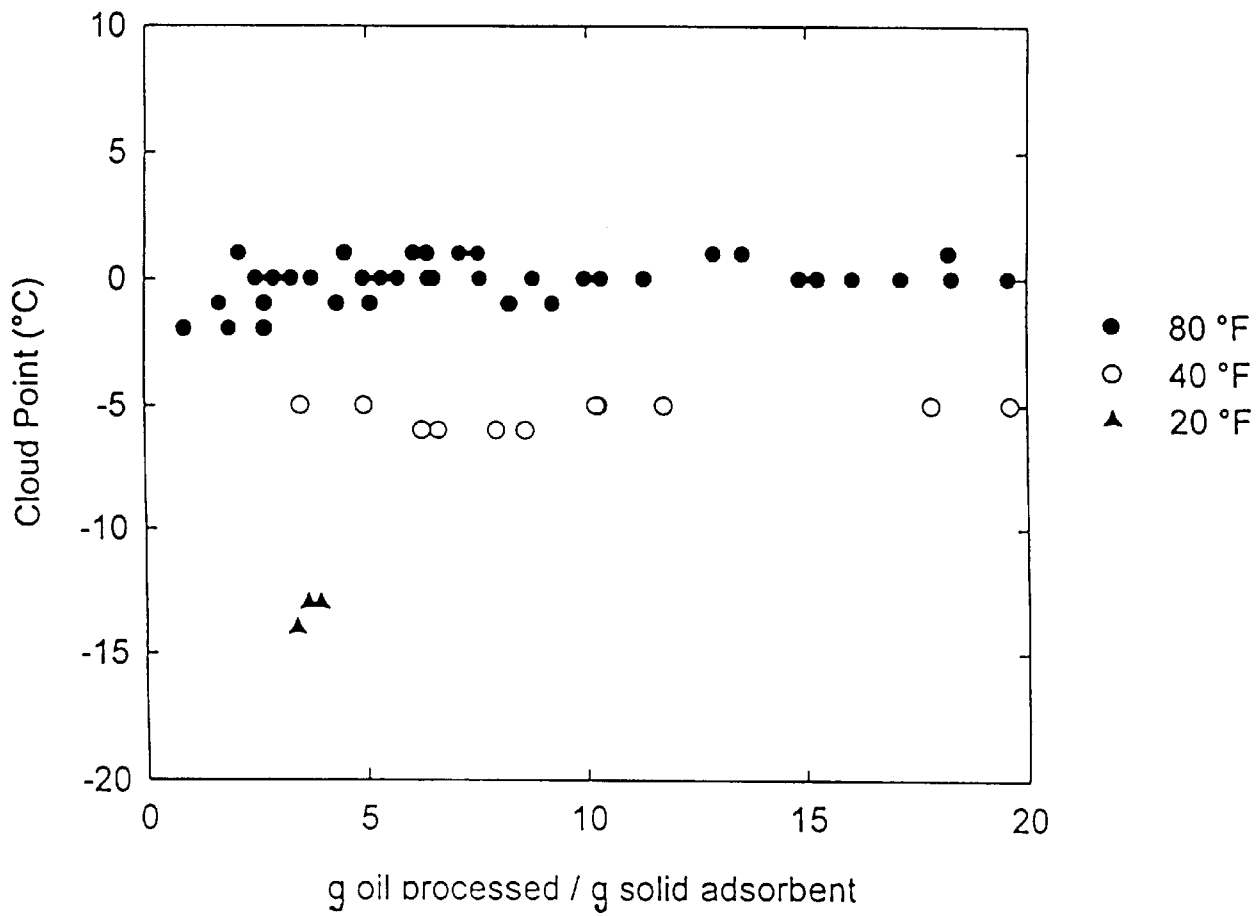
FIG. 3 illustrates the cloud point reduction of a hazy heavy neutral base oil which is passed through a pseudo-boehmite alumina adsorbent.

A heavy neutral base oil having a viscosity of 8 cSt, measured at 100° C., and a cloud point of +5° C. was treated through a bed of pseudo-boehmite sorbent at 27° C. and at feed rates (WHSV) varying from 0.05 $hr^{-1}$ to 1.0 $hr^{-1}$. The data in FIG. 3 shows that the treated oil product had a cloud point of about 5° C. through the entire test, with no observable effect of varying feed rate of sorption rate for this sample.

The sorption temperature was then reduced to 4° C., and the heavy neutral base oil treated through the pseudo-boehmite sorbent at feed rates varying from 0.1 $hr^{-1}$ to 1.8 $hr^{-1}$. The treated oil product had a cloud point of about 0° C. through the entire test, again with no observable effect of varying feed rate of sorption rate for this sample.

The sorption temperature was then reduced to −7° C., and the heavy neutral base oil treated through the pseudo-boehmite sorbent at a feed rate of 0.2 $hr^{-1}$. The treated oil product had a pour point of about −13° C. The data shows that the performance of the alumina sorbent for reducing cloud point of the 8 cSt oil improved with decreasing temperature. However, varying the feed rate had no measurable effect on cloud point reduction in this test.

Example 8

A dewaxed bright stock with a hazy appearance was treated through a bed of pseudo-boehmite adsorbent at 75° F. and at a feed rate of 1.3–1.7 $hr^{-1}$ WHSV. The properties of the hazy bright stock and the base oil recovered from the sorption process are shown in Table VI. In the sorption process the cloud point was substantially reduced and the clarity substantially improved, while pour point, color, VI and viscosity were scarcely changed at the selected sorption conditions.

TABLE VI

| | Dewaxed base oil | Dewaxed base oil after alumina adsorption |
|---|---|---|
| Point Point (° C.) | −24 | −26 |
| Cloud Point (° C.) | +17 | +5 |
| Clarity (NTU) | 5.1 | 2.6 |
| Color (ASTM 1500) | L1.0 | L1.0 |
| VI | 113 | 113 |
| Viscosity at 40° F. (cSt) | 328.8 | 239.7 |
| Viscosity at 100° F. (cSt) | 27.6 | 27.7 |

What is claimed is:

1. A process for producing an improved base oil with a reduced tendency to form a haze after standing at ambient temperatures, the process comprising contacting a base oil feed having a cloud point and having a pour point, the pour point and the cloud point defining a pour-cloud spread and wherein the pour-cloud spread of the base oil feed is 10° C. or more, with a solid sorbent for a time and at conditions sufficient to produce a dehazed base oil having a reduced cloud point relative to that of the base oil feed, such that the pour-cloud spread of the dehazed base oil is reduced by at least 5° C. relative to the pour-cloud spread of the base oil feed.

2. The process according to claim 1 wherein the pour-cloud spread of the base oil feed is 15° C. or more.

3. The process according to claim 1 wherein the base oil feed has a cloud point of greater than about 0° C.

4. The process according to claim 1 to produce a dehazed base oil having a cloud point of less than 15° C. and less than the cloud point of the base oil feed.

5. The process according to claim 4 to produce a dehazed base oil having a cloud point of less than 10° C.

6. The process according to claim 1 wherein the solid sorbent is selected from the group consisting of crystalline molecular sieves, zeolites, activated carbon, aluminas, silica-alumina and acid-activated clays.

7. The process according to claim 6 wherein the solid sorbent is an alumina selected from the group consisting of pseudo-boehmite, gamma alumina and alpha alumina.

8. The process according to claim 7 wherein the solid sorbent is pseudo-boehmite.

9. The process according to claim 1 wherein the base oil feed is contacted with the solid sorbent at a temperature of less than about 66° C. and at a feed rate of less than 10 $hr^{-1}$ WHSV.

10. The process according to claim 1 wherein the base oil feed is derived from a step of catalytic dewaxing.

11. The process according to claim 1 wherein the base oil feed has a normal boiling point greater than about 500° F. (260° C.).

12. The process according to claim 11 wherein the base oil feed has a normal boiling point greater than about 850° F. (454° C.).

13. The process according to claim 1 wherein the base oil feed has a viscosity of greater than 6.5 cSt (measured at 100° C.).

14. The process according to claim 1 wherein the base oil feed is a heavy neutral oil.

15. The process according to claim 1 wherein the base oil feed is a bright stock.

16. The process according to claim 1 wherein the base oil feed is derived from a Fischer Tropsch process.

17. The process according to claim 1 wherein the yield of lube stock based on the weight of base oil feed to the solid sorbent is greater than about 95%.

18. The process according to claim 1 wherein the solid sorbent is regenerated by passing a fluid through the bed at a temperature of greater than about 66° C, for a time sufficient to remove at least a portion of the haze precursors adsorbed on the bed of acid activated clay.

19. The process according to claim 1 wherein the base oil feed has an NTU value of greater than 2.0 and the dehazed base oil has an NTU value of less than 2.0.

20. A process for producing an improved base oil with a reduced tendency to form a haze after standing at ambient temperatures, the process comprising:

a) contacting a base oil feed having a:
   i) viscosity of greater than 6.5 cSt (measured at 100° C.),
   ii) a pour point of less than −5° C., and
   iii) a pour-cloud spread of 15° C. or more, with a solid sorbent,
      (1) at a temperature of less than 66° C. and at a flow rate of less than 10 $hr^{-1}$ WHSV, and
      (2) producing a dehazed base oil having a pour-cloud spread which is reduced by at least 5° C. relative to the pour-cloud spread of the base oil feed.

21. The process according to claim 20 wherein the base oil feed has an NTU value of greater than 2.0 and the dehazed base oil has an NTU value of less than 2.0.

22. The process according to claim 20 comprising contacting the base oil feed at a temperature in the range between about 10° C. and about 50° C.

23. The process according to claim 20 to produce a dehazed base oil having a cloud point of less than 15° C.

24. The process according to claim 20 wherein the solid sorbent is pseudo-boehmite.

25. A process for producing an improved base oil with a reduced tendency to form a haze after standing at ambient temperatures, using a vessel comprising:

i) a shell comprising a wall having an internal cavity;

ii) an inlet means within the shell, wherein the inlet means is connected to the internal cavity to afford passage of material into the cavity;

iii) an outlet means within the bottom of the shell, wherein the outlet means is connected to the internal cavity to afford passage of material out of the cavity;

iv) a porous support means that lines a lower portion of the internal surface of the shell wall to form a wall cavity between the internal surface of the shell wall and the porous support means;

v) a cover means within the internal cavity of the shell, wherein the cover means rests upon the top of the support means;

vi) a porous, vertical, hollow centerpipe that fits within the internal cavity of the shell, and below the cover means, to form an annulus between the porous support means and the centerpipe, the process comprising:

b) passing a base oil feed, having an pour-cloud spread of 10° C. or more and a pour point of less than −5° C. through said inlet means into said wall cavity;

c) passing said dewaxed oil within said wall cavity through said pour support means for contacting a sorbent contained within the internal cavity and between said wall means and said centerpipe, and forming a dehazed oil;

d) passing said dehazed oil into said centerpipe;

e) passing said dehazed oil within said centerpipe through said outlet means; and f) recovering a dehazed oil having a pour-cloud spread which is reduced by at least 5° C. relative to the pour-cloud spread of the base oil feed.

26. The process according to claim 25 wherein the base oil feed has a cloud-point of greater than about 0° C.

27. The process according to claim 25 wherein the base oil feed has an NTU value of greater than 2.0 and the dehazed base oil has an NTU value of less than 2.0.

28. The process of claim 25 comprising contacting the dewaxed oil with the sorbent at a temperature of less than 66° C. and at a feed rate of less than 10 $hr^{-1}$ WHSV.

29. The process according to claim 25 wherein the solid sorbent is selected from the group consisting of crystalline molecular sieves, zeolites, activated carbon, aluminas, silica-alumina and acid-activated clays.

30. The process according to claim 29 wherein the solid sorbent is an acid-activated clay.

31. The process according to claim 29 wherein the solid sorbent is an alumina selected from the group consisting of pseudo-boehmite, gamma alumina and alpha alumina.

32. The process according to claim 29 wherein the solid sorbent is pseudo-boehmite.

* * * * *